US006779917B1

(12) United States Patent
Chappuis

(10) Patent No.: US 6,779,917 B1
(45) Date of Patent: Aug. 24, 2004

(54) REVERSIBLE WRIST WATCH

(75) Inventor: Angélique Chappuis, Neuchâtel (CH)

(73) Assignee: The Swatch Group Management Services AG, Biel (CH)

( * ) Notice: Subject to any disclaimer, the term of this patent is extended or adjusted under 35 U.S.C. 154(b) by 0 days.

(21) Appl. No.: 09/787,706

(22) PCT Filed: Jul. 14, 2000

(86) PCT No.: PCT/EP00/06741

§ 371 (c)(1),
(2), (4) Date: Mar. 21, 2001

(87) PCT Pub. No.: WO01/07970

PCT Pub. Date: Feb. 1, 2001

(30) Foreign Application Priority Data

Jul. 22, 1999 (EP) ..... 99114443

(51) Int. Cl.[7] ..... G04B 37/00
(52) U.S. Cl. ..... 368/282; 386/281; 386/276
(58) Field of Search ..... 368/10, 276, 281, 368/282, 223; D10/33, 39

(56) References Cited

U.S. PATENT DOCUMENTS

| | | | | | |
|---|---|---|---|---|---|
| 1,930,416 | A | * | 10/1933 | Chauvot | 368/282 |
| 3,293,846 | A | * | 12/1966 | Pauli | 368/282 |
| 4,166,359 | A | | 9/1979 | Domokos | |
| 4,236,239 | A | * | 11/1980 | Imgruth et al. | 368/276 |
| 4,444,513 | A | * | 4/1984 | Proellochs et al. | 368/223 |
| 4,493,561 | A | * | 1/1985 | Bouchet | 368/281 |
| D282,913 | S | * | 3/1986 | Stevens | D10/33 |
| 4,817,064 | A | | 3/1989 | Milles | |
| 4,831,606 | A | * | 5/1989 | Aellen | 368/282 |
| D325,469 | S | * | 4/1992 | Kim | 368/282 |
| 5,138,590 | A | * | 8/1992 | Masuda et al. | 368/10 |
| 5,479,381 | A | * | 12/1995 | Goldenberg et al. | 368/282 |
| 6,340,242 | B1 | * | 1/2002 | Sandidge | 368/278 |

FOREIGN PATENT DOCUMENTS

| | | | | |
|---|---|---|---|---|
| CH | 680329 A3 | * | 8/1992 | 368/282 |
| EP | 359181 | | 3/1990 | |
| FR | 497 082 | | 11/1919 | |
| FR | 712868 | * | 10/1931 | 368/282 |
| FR | 2618919 | | 7/1987 | |

* cited by examiner

*Primary Examiner*—David Martin
*Assistant Examiner*—Jeanne-Marguerite Goodwin
(74) *Attorney, Agent, or Firm*—Sughrue Mion, PLLC

(57) ABSTRACT

The reversible watch includes first (1) and second (2) cases mounted back-to-back and each having a back cover and securing elements for securing it to the other case in a way which the user can dismantle. In a particular embodiment, each of the cases includes horns (5) through which bars (8, 9) pass. The bars are also used as means for securing the first case to the second and as means for securing each of the ends (12, 13) of the wristband (15) to the assembly formed by said first and second cases. In another embodiment, the back covers of the two cases include elements for securing them to each other, and the assembly of the two cases is mounted in a reversible manner on a support secured to a non-reversible wristband.

16 Claims, 5 Drawing Sheets

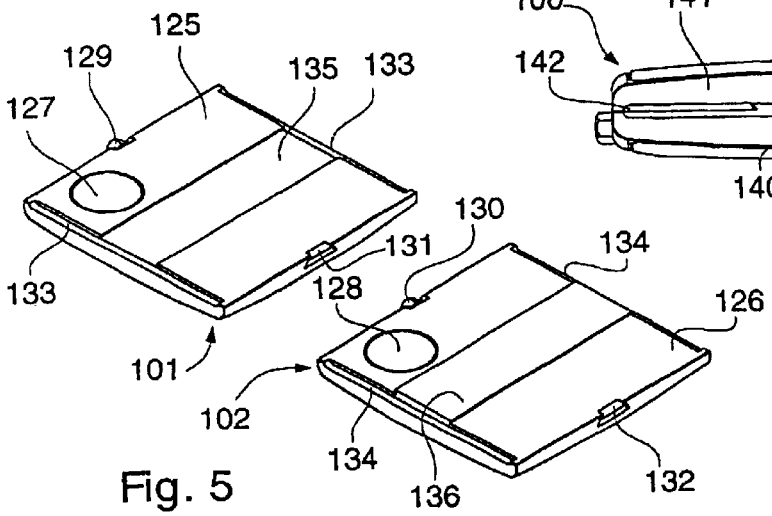
Fig. 5
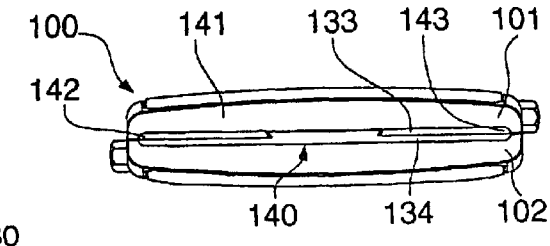
Fig. 7
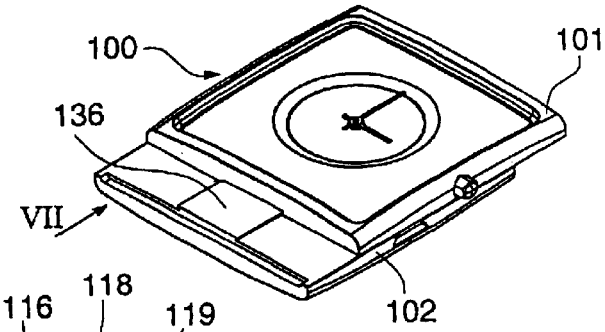
Fig. 6
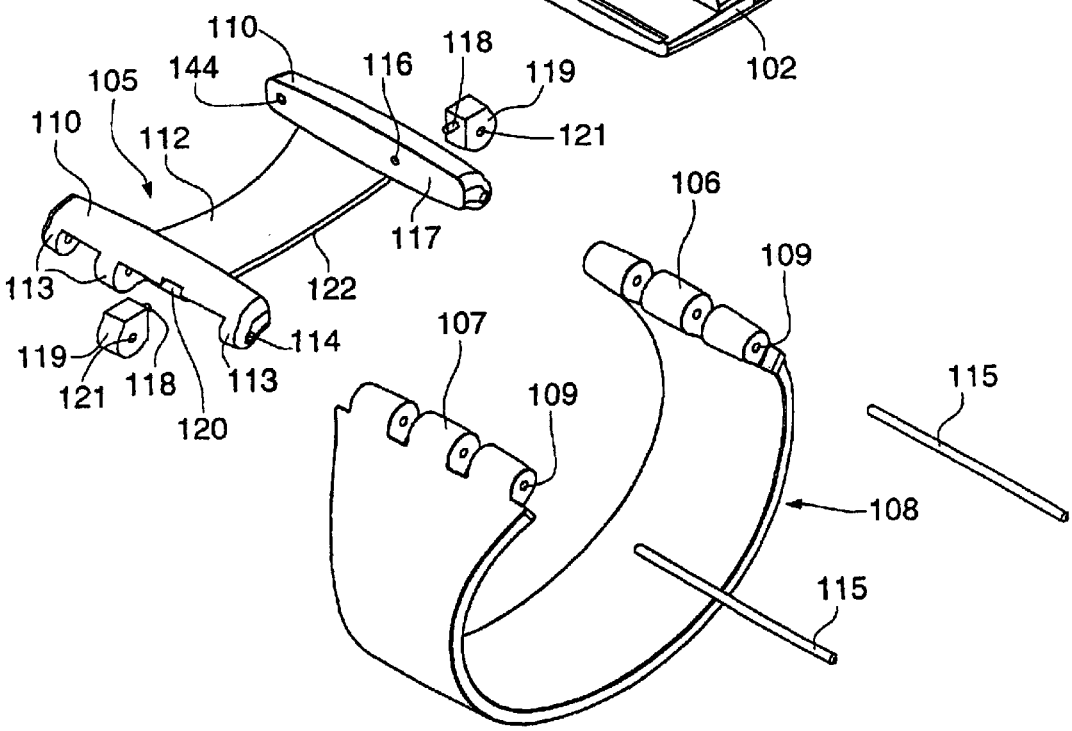

REVERSIBLE WRIST WATCH

BACKGROUND OF THE INVENTION

The present invention relates to a reversible wristwatch including a first case enclosing elements able to control a first display and a second case enclosing elements able to control a second display, said first and second cases each having a back cover and being placed back-to-back.

Several reversible watches which more or less answer the definition given above have already been proposed.

The watch disclosed in Swiss Patent No. 646 56 is formed of two parts secured to each other and each constituting one of the faces of the reversible watch.

These two parts form a single water-resistant case which is pivoted along its six o'clock-midday axis on two bars each accommodating one of the ends of a wristband. The case includes two lateral covers hinged to the case at one of their ends, covering the lateral edges of the watch case in the operating position. In this construction, the respective middle parts of the two parts of the watch are secured to each other by means of screws. In general it is to be noted that the proposed construction is complicated and requires many constituent parts both for securing the middle parts and for attaching the ends of the wristband to the assembly thereby formed. Should the two parts of the watch require batteries to operate, it is difficult to see how access could be obtained to the batteries without unscrewing all the screws connecting these two parts beforehand, which cannot easily be done by an ordinary user. European Patent No. 0 359 181 discloses a watch having a case with two displays arranged on opposite faces, this case being mounted by a hinge on a base plate secured to the wristband. This enables the case to be raised to read the display placed on the back, but the watch can obviously not be worn in this position during other activities, since it would quickly be damaged. U.S. Pat. No. 5,479,381 discloses a reversible watch having at least two opposite faces and at least one movement. The middle part is secured to an extending wristband by means of horns so that the wearer of the watch can pass from one face to the other without having to take the watch off his wrist. However the description relies on movements mounted in a single case and there is thus no reason to find a solution for attaching two distinct cases, which are themselves secured to a wristband.

Swiss Patent No. 680 329 also shows a reversible timepiece of the type indicated above in the preamble. This article includes a central portion on each side of which is mounted a complete watch with its dial directed outwards. Each watch is hinged on this central portion, this latter having horns for attaching a wristband. It is clear that this arrangement leads to a watch of significant thickness, given the presence of the central portion.

A reversible watch by the name of"Reverso" (registered trademark) is also known, made of a single case engaged on a cradle-shaped support provided with slide-ways, the support being in turn secured to the wristband. The proposed construction leads to a rather thick watch which is generally only provided with a mechanical movement, since the use of an electric movement would require, to replace the battery, either opening the case, or a lateral battery hatch if both sides of the watch were each fitted with a display. A watch of this type is disclosed, in its simplest embodiment, in French Patent No. 712 868.

SUMMARY OF THE INVENTION

It thus appears that the state of the art in field of reversible wristwatches proposes on the one hand watches with a single case, and on the other hand watches with two cases. The first category has the drawback of a generally high cost, because of the special construction of the double face case and, as appropriate, movements with double face displays, as well as difficulties concerning battery replacement in the case of electric movements. The second category, illustrated by Swiss Patent No. 680 329, has in particular the drawback that the assembly is of considerable thickness and the mounting of the cases on a common support is complicated.

The present invention concerns a watch in the second category and proposes creating a watch of moderate thickness which can be both manufactured at moderate cost and be very comfortable to use. Moreover, in the case of watches including electric batteries, this means creating a construction which allows easy replacement of the battery by the user, without the aesthetic appearance of the watch and the manufacturing cost being particularly affected.

The invention therefore concerns a reversible wristwatch of the type indicated in the preamble, characterised in that each of the two cases includes at least one securing element arranged to be attached in a removable manner to a corresponding securing element of the other case, to secure the cases to each other in a position in which their respective back covers are adjacent.

Any intermediate element such as a support arranged between the two cases, can thus be omitted, which substantially reduces the thickness of the assembly and simplifies the final assembly. Each of the two cases may advantageously be individually sealed and be designed from a common type of mono-face watch case, to which one need only add the elements for securing it to the other case. These securing elements may be concealed in the region of the back cover of the cases or may be made close to the edges of the cases in a barely visible or invisible form. Moreover, if one of each of the cases has to contain an electric battery the back cover of the case in question may includes an ordinary battery hatch, which will be concealed by the other case but will remain easily accessible to the user because the latter may easily separate the cases by dismantling their mutual securing means. Battery replacement will then be performed as in an ordinary watch.

In a particular embodiment, the securing elements of each of the cases include horns through which bars pass, these bars acting both as means for securing the first case to the second and as means for securing each of the ends of the wristband to the assembly formed by said first and second cases.

Otherwise the securing elements may be arranged on the back cover of the case, for example in the form of sliding assembly elements of the dovetail type.

In another particular embodiment, the two cases secured to each other form a movable case, which is mounted so as to pivot and slide on a support attached to a wristband, the support having two parallel lateral bars between which the movable case is placed in two mutually opposite use positions, positions in which two opposite lateral faces of the movable case extend along said bars. An advantageous arrangement in this case is for each support bar to be provided with an articulation trunnion, which is engaged in a slide-way of the corresponding lateral face of the movable case, and in that said slide-way is formed by juxtaposing two recesses of L-shaped profile, each arranged along an edge of the back cover of each case. Each trunnion may be secured to a removable part held by means of a wristband attachment bar, so that the user can easily remove the movable case from the support to separate the two cases, for example to change one of them or to replace a battery.

Other features and advantages of the present invention will appear from the following description, made with reference to the annexed drawings and presenting by way of explanatory but non-limiting example, various advantageous embodiments of the invention, wherein, in such drawings:

BRIEF DESCRIPTION OF THE DRAWINGS

FIG. 5 shows a perspective view of the two cases of the watch of FIG. 4, FIG. 6 is a blown up perspective view of the watch of FIG. 4, and FIG. 7 is a lateral view of the movable case, along the arrow VII of FIG. 6.

DETAILED DESCRIPTION OF THE INVENTION

Figure 1:
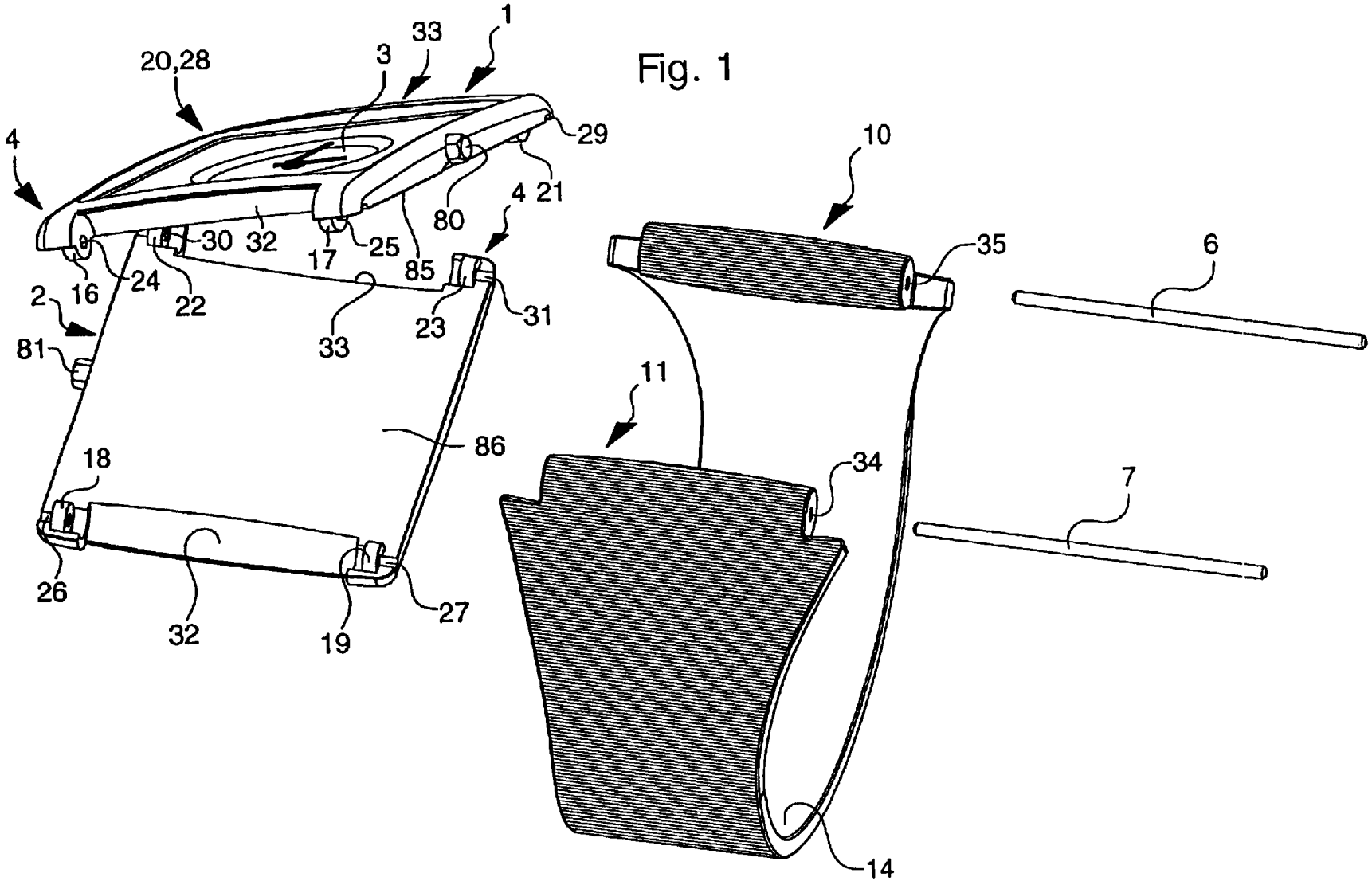
FIG. 1 is a blown up perspective view of the various elements forming a first embodiment of a reversible watch according to the invention.
Figure 2:
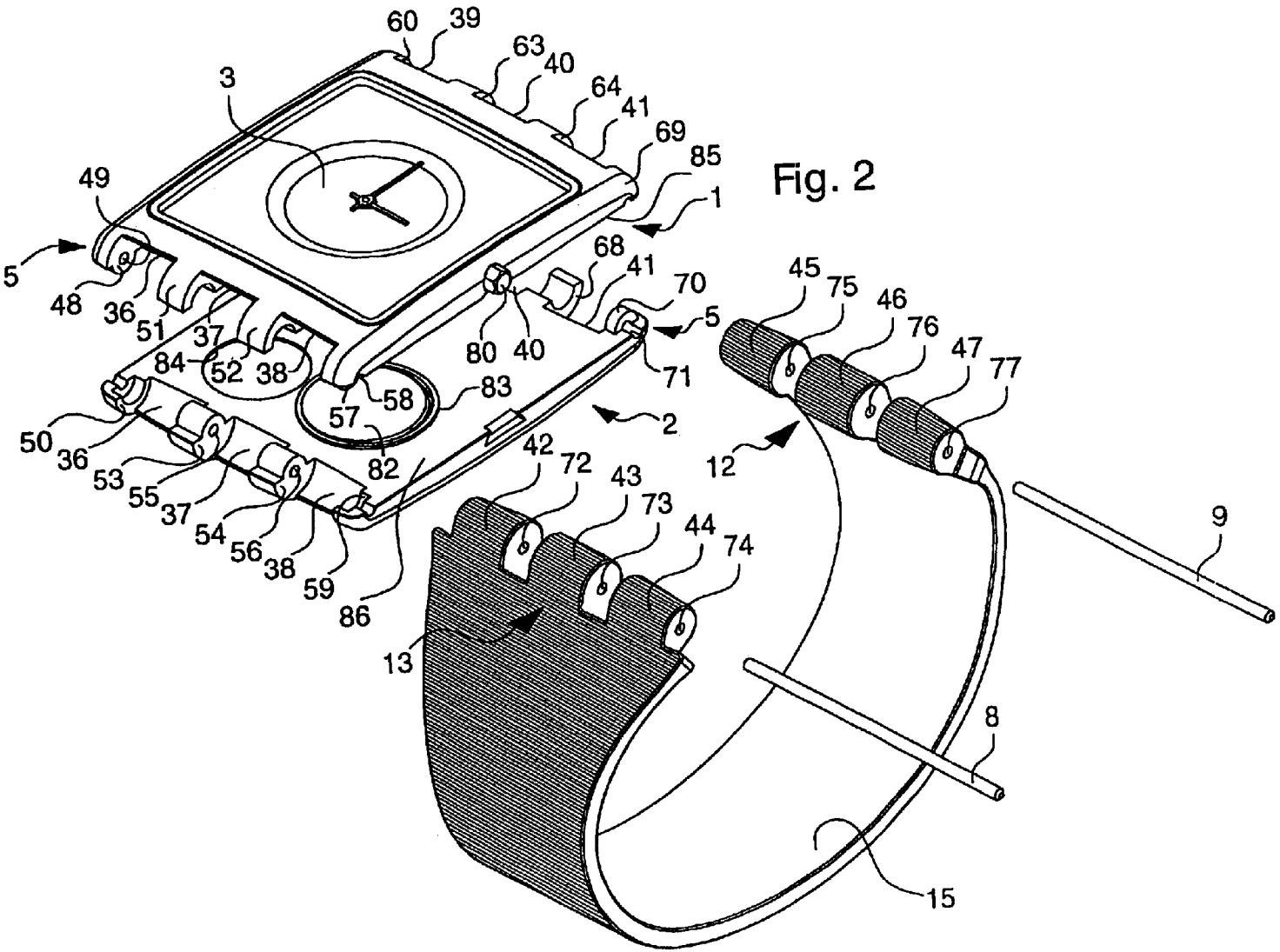
FIG. 2 is a blown up perspective view of the various elements forming a second embodiment of a reversible watch according to the invention.
Figure 3:
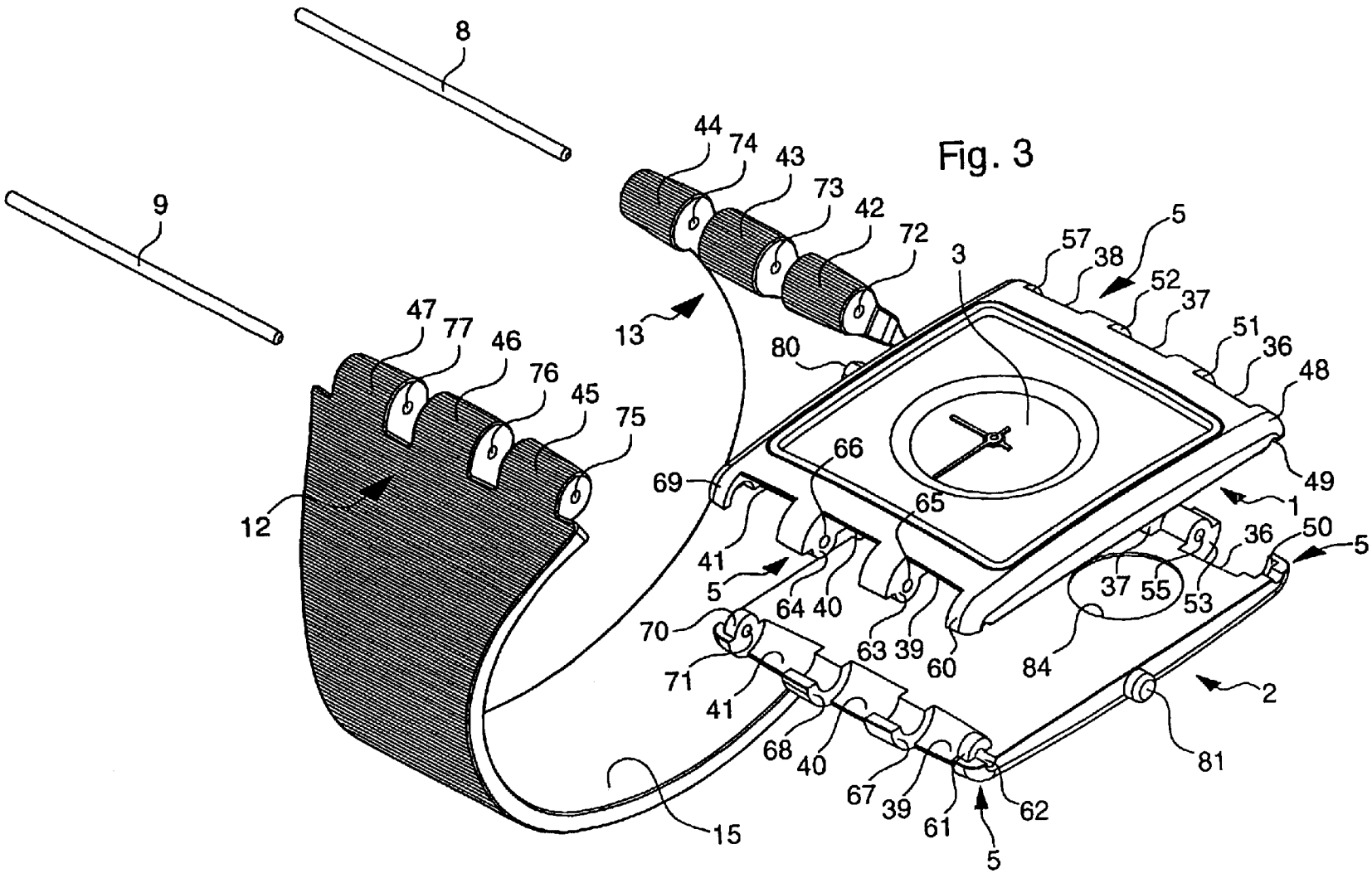
FIG. 3 shows the second embodiment shown in FIG. 2 at a different angle.

As FIGS. 1 to 3 show, the reversible wristwatch has a first case 1 enclosing elements (not shown) able to control a first display 3 and a second case 2 also enclosing elements (not shown) able to control a second display (not shown as located under case 2). These first and second cases are placed back-to-back so as to cause the displays to appear on either side of the assembly thereby formed. Display 3 shown here is an analogue display but could be of any other form, for example digital. The display not shown and affecting case 2 may be either digital or analogue. It will also be noted that cases 1 and 2 may display the time, for example the local time for the first and that of another time zone for the second. One could however, display something other than the time, for example an interval of time (chronograph function) or a message (pager function). It will thus be understood that various combinations are possible.

The reversible wristwatch according to FIGS. 1 to 3 is characterised in that each of cases 1 and 2 includes securing elements in the form of horns, referenced in the first embodiment of FIG. 1 and referenced 5 in the second embodiment of FIGS. 2 and 3, removable bars 6 and 7 passing through these horns in the first embodiment and removable bars 8 and 9 in the second embodiment. As will be noted in these Figures, these bars fulfill a dual function: on the one hand they act as means for securing first case 1 to second case 2 and, on the other hand, as means for securing each of the ends of the wristband to the assembly formed by the first and second cases. Thus ends 10 and 11 of wristband 14 of the first embodiment (FIG. 1) are secured to the assembly formed by cases 1 and 2 by bars 6 and 7 respectively. Likewise, ends 12 and 13 of wristband 15 of the second embodiment (FIGS. 2 and 3) are secured to the assembly formed by cases 1 and 2 by bars 9 and 8 respectively.

In summary, two bars only are sufficient both to secure the two cases to each other in a removable manner and to secure the ends of the wristband to the assembly thereby formed. To the Applicant's knowledge, such an arrangement has never been proposed, such arrangement considerably simplifying the assembly of the watch both as regards the time which such assembly takes and the number of parts to be implemented.

Two embodiments of the invention which put into practice the aforementioned principles will now be examined in detail.

The first embodiment is illustrated in FIG. 1. The reversible watch includes a first case 1 with its display 3 and a time-setting control crown 80 and a second case 2 whose display is not apparent, this second case having its own time-setting control crown 81. The two cases 1 and 2 are arranged back-to-back, so that their respective back covers 85 and 86 are adjacent. First case 1 includes, at six o'clock, a pair of horns 16 and 17 and, at twelve o'clock, another pair of horns 20 and 21. Second case 2 includes, at six o'clock, a pair of horns 18 and 19 and, at twelve o'clock, another pair of horns 22 and 23. Each of these horns is provided with a hole respectively referenced 24, 25, 28, 29, 26, 27, 30 and 31. The diameter of each hole is adjusted to the diameter of bars 6 and 7. Each horn of first case 1 is juxtaposed with a corresponding horn of second case 2. Thus, horn 16 is located next to horn 18, horn 17 next to horn 19, horn 20 (not shown) next to horn 22 and horn 21 next to horn 23. When the corresponding horns are juxtaposed, i.e. when cases 1 and 2 are placed back-to-back, a recess 32 is created at six o'clock which is occupied by end 11 of wristband 14, and a recess 33 is created at twelve o'clock which is occupied by end 10 of wristband 14. Ends 11 and 10 of wristband 14 are provided with a hole referenced respectively 34 and 35. These holes 34 and 35 are arranged in alignment with the hole of horns to accommodate bars 7 and 6 which are inserted by sliding through the horns, so that, once inserted, these bars secure the first case to the second and wristband 14 onto the assembly thereby formed.

In the embodiment shown in FIG. 1, it can be seen that case 1 may also be mounted on case 2 by rotating it through 180° in its plane. This would then produce an incorrect mounting unsuited to a reversible wristwatch. This takes account of the symmetrical arrangement of the horns of first case 1 with respect to the horns of second case 2. In order to avoid this, the symmetry can be broken for example by moving horns 16 and 17 of case 1 towards the exterior of said case 1 and horns 18 and 19 of case 2 towards the inside of said case. At that moment, case 1 can only be mounted in a single direction on case 2.

The second embodiment is illustrated in FIGS. 2 and 3. In this embodiment, the first and second cases 1 and 2 include, at six o'clock and at twelve o'clock, four horns 5, each horn of the first case being superposed on and encased in a horn of the second case when the cases are placed back-to-back. At that moment, three recesses are created at six o'clock and twelve o'clock, namely recesses 36, 37 and 38 at six o'clock and recesses 39,40 and 41 at twelve o'clock. Recesses 36, 37 and 38 are 30 occupied by end 13 of wristband 15, this end being divided into three sections 42, 43 and 44. Recesses 39, 40 and 41 are occupied by end 12 of wristband 15, this end being divided into three sections 45, 46 and 47.

First case 1 has, at six o'clock and in order, a first male horn 48 provided with a hole 49 and encased in a first female horn 50 of second case 2, second 51 and third 52 female horns respectively encased in second 53 and third 54 male horns of second case 2, the male horns each being fitted with a hole respectively referenced 55 and 56, and a fourth male horn 57 provided with a hole 58 and encased in a fourth female horn 59 of second case 2. First case 1 has, at twelve o'clock and in order, a first female horn 60 encased on a first male horn 61 of second case 2, this horn 61 being provided with a hole 62, second 63 and third 64 male horns each provided with a hole respectively referenced 65 and 66 and respectively encased in second 67 and third 68 female horns of second case 2, and a fourth female horn 69 encased in a fourth male horn 70 of second case 2, this horn 70 being provided with a hole 71. The three sections 42, 43 and 44 of end 13 of wristband 15 are provided with a hole respectively referenced 72, 73 and 74 and the three sections 45, 46 and 47 of end 12 of wristband are provided with a hole respectively referenced 75, 76 and 77. These holes are arranged in alignment with the holes of the horns to accommodate removable bars 8 and 9 which secure first case 1 to second case 2 and wristband 15 to the assembly thereby formed.

In the embodiment shown in FIGS. 2 and 3, it can be seen that case 1 can only be mounted one way on case 2 and that it is therefore not possible to rotate it by 180° in its plane then to mount it on case 1. This is due to the configuration and alternating male and female horns. Indeed, if case 1 is rotated in the wrong direction, male horns 63 and 64 of case 1 will meet other male horns, in this case male horns 53 and 54 of case 2.

The embodiment shown in FIG. 2 shows, in back cover 86 of case 2, a cover 82 closing a battery hatch 83. Since this cover can exceed the level of the back of case 2, a recess in portion 84 is provided In back cover 85 of case 1, as shown in FIGS. 2 and 3, this recess in portion being Intended to accommodate a battery hatch cover which is not visible and which Is located in the back cover of case 1.

It will also be noted that the embodiment shown in FIGS. 2 and 3 uses the construction of the Swatch (registered trademark) watch wherein the ends of the wristband each include three sections and the case two times four horns.

It will be noted finally that the present invention offers an extremely thin reversible watch especially if two cases of small thickness are selected, such as, for example, those marketed under the name Swatch Skin (registered trademark).

The way in which wristband 14 or 15 is manufactured is not described here. It may be an extending wristband as disclosed in U.S. Pat. No. 5,479,381 or a leather strap provided with a pivoting buckle, as disclosed in German Patent No. 35 12 369.

In the event that first and second cases 1 and 2 are fitted with power supply batteries, it can be seen that the arrangement proposed by the invention allows the batteries to be changed easily. One need only take out the bars to separate the cases and have access to the battery hatches. The horns on one side of the watch may further be arranged to form a hinge, so that one need only take out the bar from the other side to separate the cases and have access to each battery hatch.

In the embodiment shown in FIGS. 4 to 7, the reversible wristwatch includes a reversible movable case 100 formed by assembling a first case 101, enclosing a first clockwork movement provided with a first display 103, for example of the analogue type, and a second case 102 enclosing a second clockwork movement provided with a second display 104, for example of the digital type. Cases 101 and 102 have a generally square or rectangular shape and are arranged back-to-back, so that their displays 103 and 104 appear respectively on the two opposite faces of movable case 100. As in the preceding example, the two displays may be arranged to display the time, but one or the other could display something else, for example a measured time, an alarm time, stored data, a message received via radio or other alphanumerical data, or combinations of such elements.

Movable case 100 is mounted so as to pivot and slide on a rigid support 105 secured to the two ends 106 and 107 of a wristband 108 which may or may not be reversible. This support is shown in detail in FIG. 6 and includes two parallel bars 110 connected by a bottom plate 112, so that support 105 has a cradle shape longitudinally the inside of which is occupied by movable case 100. Each bar 110 includes horns 113 provided with holes 114 for attachment to wristband 108 in the same way as in the preceding example, i.e. by means of two removable bars 115 which also pass through holes 109 of ends 106 and 107 of the wristband.

Figure 4:
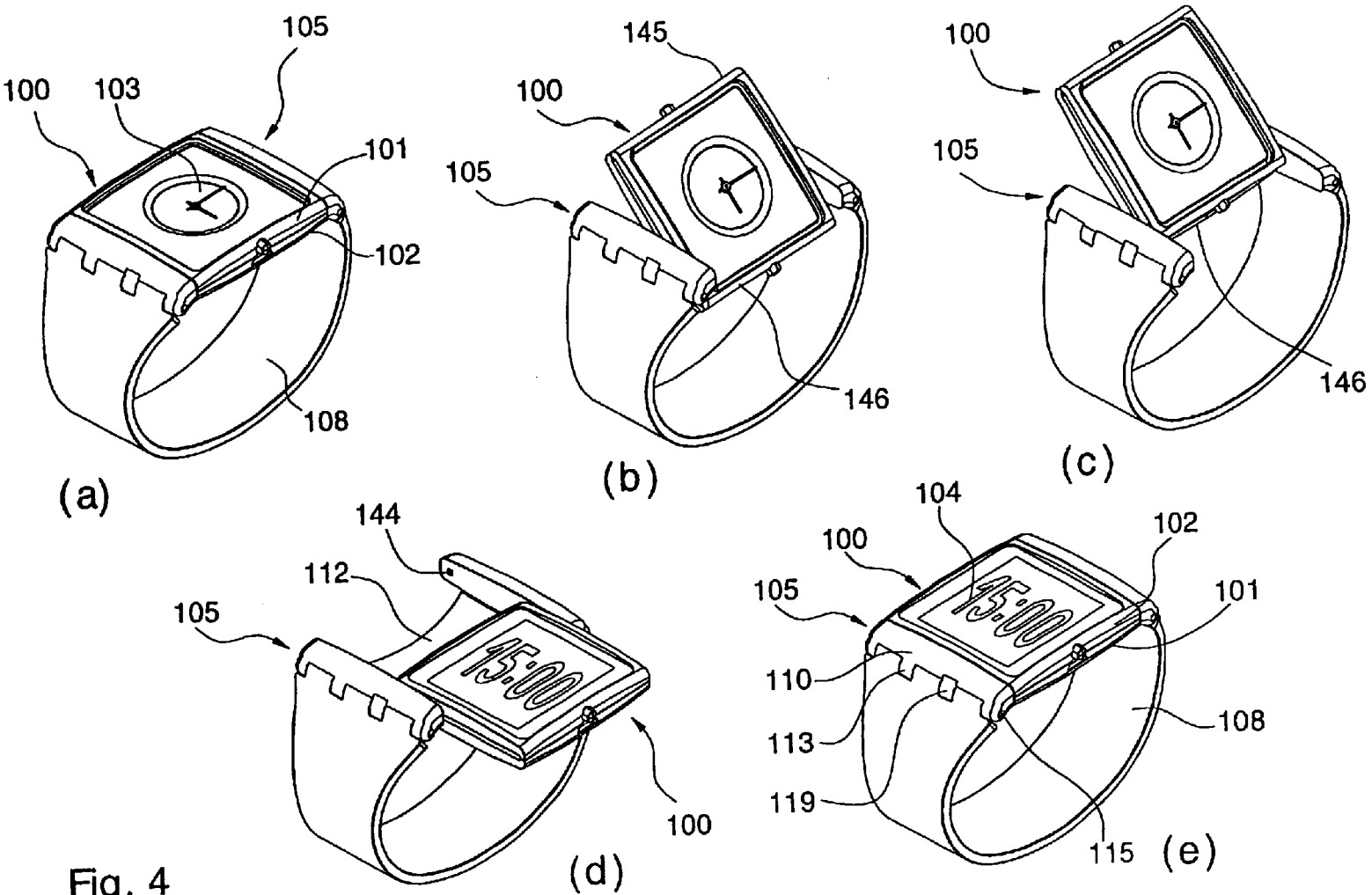
FIG. 4 shows a perspective view of a third embodiment of a reversible watch according to the invention, in five successive positions of a movable case formed of two cases arranged back-to-back.

Each bar 110 includes a through hole 116 opening out into an inner vertical face 117 of the bar, facing the opposite bar 110. Each hole 116 is intended for the passage of a cylindrical trunnion 118 secured to a removable part 119 which is housed in a recess 120 of bar 110, while trunnion 118 engaged through hole 116 emerges from face 117 of the bar to form an articulation pivot. Each part 119 has the same external shape as horns 113 and, like the latter, it includes a hole 121 intended for the passage of bar 115, so that this bar holds part 119 In position in bar 110 as is seen in FIG. 4(*e*). It will also be noted that inner plate 112 of support 105 does not extend over the entire length of bars 110, but has an edge 122 set back from a vertical line passing through holes 116, in order to release the space below trunnions 118 for a reason which will appear hereinafter.

In FIG. 5, the two cases 101 and 102 are shown so that their respective back covers 125 and 126 are visible, provided with battery hatches 127 and 128 to allow easy replacement of the battery powering the clockwork movement. A control crown 129 is provided on case 101, as is a control crown 130 on case 102, in the usual position. On its side opposite the crown, each case has a small recess 131, 132, which, when the cases are assembled as is seen in FIG. 4, allows the user to insert a nail under the crown to pull it. Along the two other edges opposite the back cover of first case 101, there are two longitudinal recesses 133 having an L-shaped profile and extending symmetrically over most of the length of the side of the case. Two similar longitudinal recesses 134 are arranged along two opposite edges of back cover 126 of second case 102. Further, a wide groove 135 having a dovetail profile passes right through back cover 125 of first case 101 in its central zone. Likewise, in its central zone, back cover 126 of second case 102 has a wide rib 136 having a dovetail profile which corresponds to that of groove 135 in order to be encased therein by sliding In it when the cases are put back-to-back, in the position shown in FIG. 6. Thus, groove 135 and rib 136 constitute elements for directly securing one case to another without inserting any intermediate element.

When the two cases 101 and 102 are thus assembled, as is seen in FIG. 7, their respective longitudinal recesses 133 and 134, which are juxtaposed along each side of movable case 100, together form a longitudinal slide-way 140 In each lateral face 141 of the movable case, this slide-way having closed ends 142 and 143. When movable case 100 is placed between the two bars 110 of support 105, the two mutually opposite trunnions 118 are each engaged in one of slide-ways 140 of movable case 100, so that the latter can pivot and slide on the trunnions, while the two cases are held laterally by faces 117 of bars 110. Sliding is stopped by one or other of ends 142 and 143 of the slide-ways.

When the movable cases is placed flat in support 105 in one of the two positions (a) and (e) shown in FIG. 4, it is prevented from pivoting and sliding by two opposite clicks 144 which emerge from faces 117 of the bars engaging in slide-way 140. A click of this type may be formed by a pin with a spherical head mounted on a spring.

FIG. 4 shows five successive positions (a) to (e) of movable case 100 when a user turns it. Position (a) is a first use position wherein first case 101 presents its analogue display 103. By lifting up the left edge 145 of the case, the holding of clicks 144 is overcome and the case is set in inclined position (b) by pivoting on trunnions 118. The right edge 146 of the case is then lowered between bars 110 of support 105, in the zone into which central plate 112 does not extend. In order to pass to position (c), the case is pulled backwards so that it slides on the trunnions to the corresponding end of slide-way 140. Edge 146 of the case is then higher than plate 112. Case 100 is then pivoted to the horizontal position (d) then it is made to slide horizontally to the left above plate 112 to bring it to the second use position (e) wherein case 102 is at the top and presents its digital display 104. Clicks 144 are then again engaged in slide-way 140 to stabilise movable case 100.

The same operations are repeated to pass from position (e) to position (a).

The construction described above allows the batteries contained in cases 101 and 102 to be replaced easily, both by an average user and by a watchmaker. The two cases can be separated as shown in FIG. 6, by removing the two bars 115, then the two parts 119 to separate movable case 100 from support 105, then the two cases are separated by sliding the dovetail assembly. The two battery hatches 127 and 128 then become accessible as in an ordinary watch. Next, the watch is reassembled by the reverse operations.

It will be noted that in the example shown in FIGS. 4 to 7, trunnions 118 are not in proximity to one end of bars 110 of the support, because removable parts 119 which carry them cannot transmit force between the wristband and the support and would not be properly guided to the end of the bar. One may however design variants wherein trunnions 118 are situated very close to the end of the bar in order to abut against one end of slide-way 140 in the two use positions of the case. For example, each trunnion could be provided at the end of a screw passing through the bar.

It will be noted that the watch shown in FIGS. 4 to 7 could also include stop members to prevent the movable case moving to the left beyond positions (a) and (e) of FIG. 4. For example, ends 142 and 143 of slide-way 140 could be deepened or widened locally so that clicks 144 engage more deeply therein. Another solution consists in providing at least one stop projecting at the left end of each face 117 of bars 110, to act as a stop for the movable case. A stop of this type may also be formed by an element connecting the left ends of the two bars to form a rigid U-shaped frame. Plate 112 could then be omitted.

Instead of sliding the movable case on the support in a perpendicular direction to the wristband, with pivoting about an axis parallel to the general direction of the wristband, one can provide the opposite arrangement, i.e. sliding the case in a direction parallel to the wristband, without departing from the scope of the invention. In such case, horns 113 of support 105 could be replaced by horns arranged in the extension of bars 110, or by two handles connecting the ends of the two bars and each attached to one end of the wristband, the support then having the form of a rectangular frame. These handles may also be provided with several similar horns to horns 113 shown in FIGS. 4 and 6.

What is claimed is:

1. A reversible wristwatch including a first case enclosing first elements able to control a first display and a second case enclosing second elements able to control a second display, said first and second cases each having a back cover and being placed back-to-back, wherein each of said first and second cases includes at least one securing element arranged to be secured in a removable manner to a corresponding securing element of the other of said first and second cases, to secure the first and second cases to each other in a position in which their respective back covers are adjacent, wherein the securing elements of each of the first and second cases include horns through which bars pass, said bars acting both as means for securing the first case to the second case and means for securing opposite ends of the wristband to an assembly formed by said first and second cases, and wherein the first and second cases include at six o'clock and twelve o'clock four horns, each horn of the first case being superposed on and encased in a horn of the second case when said cases are placed back-to-back to define at six o'clock and twelve o'clock three recesses which are occupied by the corresponding end of the wristband divided into three sections, the first case having at six o'clock and in order, a first male horn provided with a hole and encased in a first female horn of the second case, second and third female horns respectively encased in second and third male horns of the second case which are each provided with a hole; and a fourth male horn provided with a hole and encased in a fourth female horn of the second case, said first case having, at twelve o'clock and in order, a first female horn encased on a first male horn of the second case, said first male horn being provided with a hole, second and third male horns each provided with a hole and respectively encased in second and third female horns of the second case, and a fourth female horn encased in a fourth male horn of the second case, said fourth male horn being provided with a hole, each of the three sections of the ends of the wristband being provided with a hole arranged in alignment with the holes of the horns to accommodate the bars which secure the first case to the second case and the wristband to the assemble thereby formed.

2. The wristwatch of claim 1, wherein each case contains an electric battery and includes a battery hatch provided with a removable cover in its back cover.

3. A reversible wristwatch including a first case enclosing first elements able to control a first display and a second case enclosing second elements able to control a second display, said first and second cases each having a back cover and being placed back-to-back, wherein each of said first and second cases includes at least one securing element arranged to be secured in a removable manner to a corresponding securing element of the other of said first and second cases, to secure the first and second cases to each other in a position in which their respective back covers are adjacent, and wherein the first and second cases secured to each other form a movable case, which is mounted so as to pivot and slide on a support secured to a wristband, the support having two parallel lateral bars connected to each other, between which the movable case occupies two mutually reversed use positions, in which two opposite lateral faces of the movable case extend along said bars.

4. The wristwatch of claim 3, wherein each lateral bar of the support is provided with an articulation trunnion which is engaged in a slide-way of the corresponding lateral face of the movable case, and wherein said slide-way is formed by juxtaposing two recesses of L-shaped profile, each arranged along an edge of the back cover of each case.

5. The wristwatch of claim 4, wherein each lateral bar of the support is provided with securing means including a removable bar for securing it to the wristband and wherein said trunnion is secured to a removable part which is held in place on the bar by means of the removable bar.

6. The wristwatch of claim 3, wherein the movable cased slides along the support in a perpendicular direction to the wristband.

7. The wristwatch of claim 3, wherein the movable case slides on the support in a parallel direction to the wristband.

8. The wristwatch of claim 3, wherein each case contains an electric battery and includes a battery hatch provided with a removable cover in its back cover.

9. A reversible wristwatch including a first case enclosing first elements able to control a first display and a second case enclosing second elements able to control a second display, said first and second cases being individually sealed and each having a back cover and being placed back-to-back, wherein each of said first and second cases includes at least one securing element arranged to be secured in a removable manner to a corresponding securing element of the other of said first and second cases, to secure the first and second cases to each other in a position in which their respective back covers are adjacent, and wherein said securing elements are arranged on the back cover of each of said first and second cases.

10. The wristwatch of claim 9, wherein the securing elements include assembly elements of the dovetail type.

11. The wristwatch of claim 9, wherein the first and second cases secured to each other form a movable case, which is mounted so as to pivot and slide on a support secured to a wristband, the support having two parallel lateral bars connected to each other, between which the movable case occupies two mutually reversed use positions in which two opposite lateral faces of the movable case extend along said bars.

12. The wristwatch of claim 11, wherein each lateral bar of the support is provided with an articulation trunnion which is engaged in a slide-way of the corresponding lateral face of the movable case, and wherein said slide-way is formed by juxtaposing two recesses of L-shaped profile, each arranged along an edge of the back cover of each case.

13. The wristwatch of claim 12, wherein each lateral bar of the support is provided with securing means including a removable bar for securing it to the wristband and wherein said trunnion is secured to a removable part which is held in place on the bar by means of the removable bar.

14. The wristwatch of claim 11, wherein the movable case slides along the support in a perpendicular direction to the wristband.

15. The wristwatch of claim 11, wherein the movable case slides on the support in a parallel direction to the wristband.

16. The wristwatch of claim 9, wherein each case contains an electric battery and includes a battery hatch provided with a removable cover in its back cover.

* * * * *